US008515311B2

(12) United States Patent
Kishi

(10) Patent No.: US 8,515,311 B2
(45) Date of Patent: Aug. 20, 2013

(54) IMAGE FORMING APPARATUS FEATURING A ROTATABLE BELT MEMBER ADJUSTMENT ROLLER

(75) Inventor: Takehiro Kishi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 427 days.

(21) Appl. No.: 12/836,693

(22) Filed: Jul. 15, 2010

(65) Prior Publication Data

US 2011/0026954 A1 Feb. 3, 2011

(30) Foreign Application Priority Data

Jul. 31, 2009 (JP) ..... 2009-179900

(51) Int. Cl.
*G03G 15/08* (2006.01)

(52) U.S. Cl.
USPC ..... 399/121; 399/302; 399/308; 399/316; 399/317; 399/388; 399/389

(58) Field of Classification Search
USPC ..... 399/121, 316–317, 388–389
See application file for complete search history.

(56) References Cited

U.S. PATENT DOCUMENTS

| | | | | |
|---|---|---|---|---|
| 7,221,894 | B2 | 5/2007 | Kishi | |
| 7,483,661 | B2 | 1/2009 | Kishi | |
| 8,126,342 | B2 * | 2/2012 | Gibson et al. | 399/44 |
| 8,135,320 | B2 * | 3/2012 | Matsumoto et al. | 399/316 |
| 8,311,465 | B2 * | 11/2012 | Nomura et al. | 399/302 |
| 2008/0019717 | A1 * | 1/2008 | Soshiroda | 399/45 |
| 2009/0142083 | A1 * | 6/2009 | Minbu | 399/45 |
| 2009/0208257 | A1 * | 8/2009 | Matsumoto | 399/308 |
| 2009/0297241 | A1 * | 12/2009 | Kim et al. | 399/388 |
| 2011/0044731 | A1 * | 2/2011 | Nomura et al. | 399/302 |
| 2012/0076554 | A1 * | 3/2012 | Kaseda | 399/316 |
| 2012/0082489 | A1 * | 4/2012 | Shirakata | 399/302 |
| 2012/0282001 | A1 * | 11/2012 | Akashi et al. | 399/308 |
| 2012/0308274 | A1 * | 12/2012 | Leighton et al. | 399/317 |

FOREIGN PATENT DOCUMENTS

| | | |
|---|---|---|
| JP | 2003-167444 A | 6/2003 |
| JP | 2007-57715 A | 3/2007 |

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus includes a belt member which bears a toner image, a transfer portion for forming a transfer nip portion, a changing unit for changing an advancing angle of the belt member advancing into the transfer nip portion, a guide member which is arranged at an upstream side of the transfer nip portion in a recording material conveying direction and face to a untransfered face of the recording material and guide a recording material to the transfer nip portion, and a controller for controlling the changing unit so that a belt face advancing into the transfer nip portion and conveying a recording material having a first thickness is at a position farther from the guide member than the belt face advancing into the transfer nip portion and conveying a recording material having a second thickness smaller than the first thickness.

7 Claims, 5 Drawing Sheets

FIG. 3B

UNIT: °

| | ENVIRONMENT | TEMPERATURE: 23°C, HUMIDITY: 5% | | | | TEMPERATURE: 25°C, HUMIDITY: 50% | | | | TEMPERATURE: 30°C, HUMIDITY: 80% | | | |
|---|---|---|---|---|---|---|---|---|---|---|---|---|---|
| | PAPER TYPE | PLAIN PAPER | | COATED PAPER | | PLAIN PAPER | | COATED PAPER | | PLAIN PAPER | | COATED PAPER | |
| | PAPER GRAIN | LONG GRAIN | SHORT GRAIN | LONG GRAIN | SHORT GRAIN | LONG GRAIN | SHORT GRAIN | LONG GRAIN | SHORT GRAIN | LONG GRAIN | SHORT GRAIN | LONG GRAIN | SHORT GRAIN |
| BASIS WEIGHT (g/m^2) | 36 | 30 | 30 | 30 | 30 | 30 | 30 | 30 | 30 | 30 | 30 | 30 | 30 |
| | 64 | 30 | 30 | 30 | 30 | 30 | 30 | 30 | 30 | 30 | 30 | 30 | 30 |
| | 105 | 20 | 20 | 20 | 20 | 20 | 30 | 20 | 30 | 20 | 30 | 20 | 30 |
| | 150 | 10 | 15 | 10 | 15 | 15 | 20 | 15 | 20 | 15 | 20 | 15 | 20 |
| | 200 | 5 | 10 | 5 | 10 | 10 | 15 | 10 | 15 | 10 | 15 | 10 | 15 |
| | 250 | 0 | 5 | 0 | 5 | 5 | 10 | 5 | 10 | 5 | 10 | 5 | 10 |
| | 300 | 0 | 0 | 0 | 0 | 0 | 5 | 0 | 5 | 0 | 5 | 0 | 5 |
| | 350 | 0 | 0 | 0 | 0 | 0 | 0 | 0 | 0 | 0 | 0 | 0 | 0 |

RIGIDITY:TRANSFER MATERIAL A < TRANSFER MATERIAL B < TRANSFER MATERIAL C

IMAGE FORMING APPARATUS FEATURING A ROTATABLE BELT MEMBER ADJUSTMENT ROLLER

BACKGROUND OF THE INVENTION

1. Field of the Invention

The present invention relates to an image forming apparatus including a rotatable belt member which is stretched over a plurality of rollers.

2. Description of the Related Art

In the related art, an electrophotographic type image forming apparatus is known. In such an image forming apparatus, a primary charging device uniformly charges a surface of an image bearing member, and then an exposing device irradiates the image bearing member with light to form an electrostatic image on the surface of the image bearing member. Then, toner of a developer (including carrier and toner, or including toner) is developed from a developer bearing member arranged in a developing device to the image bearing member. The developed toner is transferred to a recording material by a transfer device, and the recording material is then separated from the image bearing member. A fixing device applies heat and pressure to the recording material to which the toner is transferred so as to fix the toner on the recording material.

In the image forming apparatus, an intermediate transfer belt system may be employed in transferring the developed image to the recording material by the transfer device. A disadvantage of the intermediate transfer system is that an image defect occurs when a developed image is transferred to a recording material. In particular, an image defect of scattering occurs due to scattering of toner resulting in that a developed image on an intermediate transfer belt cannot be accurately transferred. Japanese Patent Application Laid-Open No. 2003-167444 discusses an invention to reduce such image defects due to scattering of toner.

The invention discussed in Japanese Patent Application Laid-Open No. 2003-167444 relates to an image forming apparatus in which a toner layer is deposited on an intermediate transfer member, and the toner layer is then transferred to a recording material at a secondary transfer portion at one time. In the invention of Japanese Patent Application Laid-Open No. 2003-167444, one of a pair of conveying rollers in the upstream proximity of the secondary transfer portion is set to have higher circumferential speed and greater coefficient of friction against the recording material than the other conveying roller of the pair. The conveying roller having higher circumferential speed and greater coefficient of friction is one which abuts a non-image forming surface of the recording material. With such a structure, an image defect due to abnormal electrical discharge immediately before the secondary transfer portion can be prevented from occurring, and a high quality image can be output.

However, the invention discussed in Japanese Patent Application Laid-Open No. 2003-167444 is disadvantageous in the following respect due to the rigidity of the recording material when the recording material is held by a nip portion of the secondary transfer portion. Specifically, if the recording material has high rigidity, the recording material is shifted toward the intermediate transfer belt side and gets curved when the recording material is held by the nip portion. Then, a gap is generated between the recording material and the intermediate transfer belt within the transfer electric field, and the toner forming the developed image scatters. A defective image is thus formed.

On the contrary, if the recording material has low rigidity, the distance between the recording material and the intermediate transfer belt increases in a transfer region formed in the vicinity of the nip portion when the recording material is held by the nip portion. Then, the toner forming the developed image scatters in the transfer electric field, thus forming a defective image In view of the circumstances, the present invention provides an image forming apparatus which can reduce load applied to a recording material during secondary transfer to reduce image defects due to scattering of the toner occurring at a secondary transfer portion.

The present invention provides an image forming apparatus which reduces disturbance of a toner image transferred to a recording material at a secondary transfer portion.

SUMMARY OF THE INVENTION

An image forming apparatus includes rotatable belt member which bears a toner image, a transfer portion for forming a transfer nip portion which transfers the toner image on the belt member on a recording material, a changing unit for changing an advancing angle of the belt member advancing into the transfer nip portion, a guide member which is arranged at an upstream side of the transfer nip portion in a recording material conveying direction and adapted to come in contact with a face of a recording material opposite to a face to which the toner image is transferred from the belt member to guide the recording material to the transfer nip portion, and a controller for controlling the changing unit so that a belt face advancing into the transfer nip portion when a recording material having a first thickness is conveyed to the transfer nip portion is at a position farther from the guide member than the belt face advancing into the transfer nip portion when a recording material having a second thickness smaller than the first thickness is conveyed to the transfer nip portion.

Further features of the present invention will become apparent from the following description of exemplary embodiments with reference to the attached drawings.

BRIEF DESCRIPTION OF THE DRAWINGS

FIG. 3B is a table illustrating a relation between the type of recording materials and the intersection angle;

DESCRIPTION OF THE EMBODIMENTS

In the following, an exemplary embodiment of the present invention will be described in detail in an exemplified manner with reference to the drawings. Here, dimensions, materials, shapes and relative arrangement of structural components described in the following embodiment may be appropriately modified according to apparatus configurations to which the present invention is applied and various conditions, and thus do not limit the scope of the present invention unless otherwise specified.

Figure 1A:
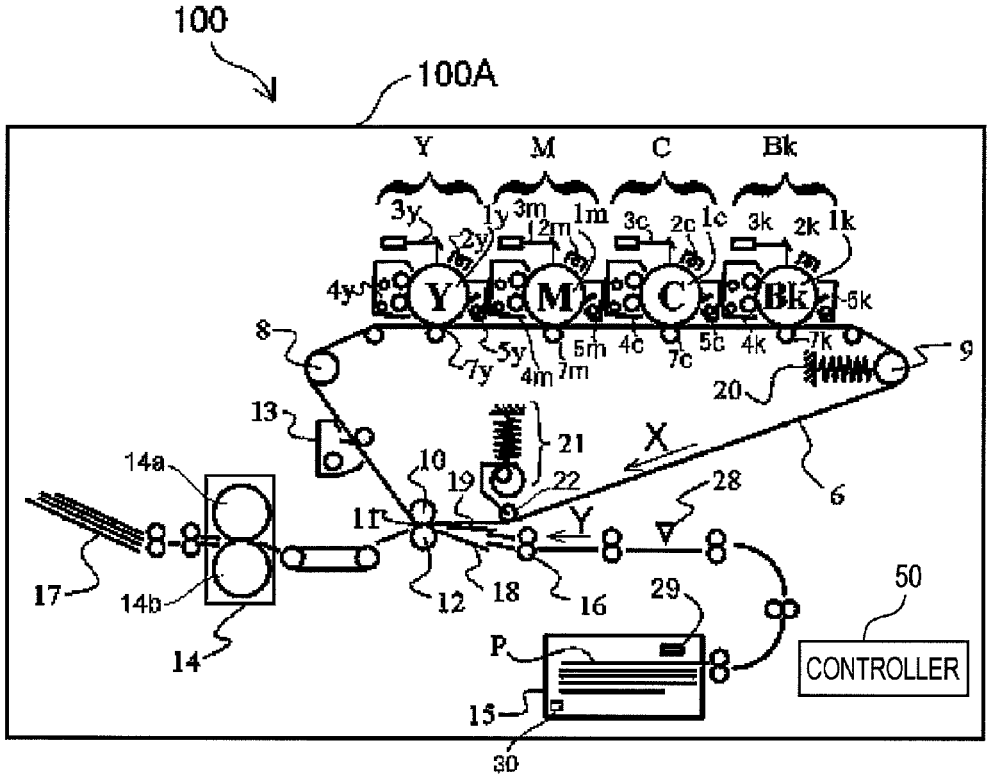
FIG. 1A is a sectional view illustrating a structure of an image forming apparatus according to an embodiment of the present invention.

FIG. 1A is a sectional view illustrating a structure of an image forming apparatus 100 according to an embodiment of the present invention. As illustrated in FIG. 1A, the image forming apparatus 100 includes an image forming apparatus main body (hereinafter, simply called "apparatus main body 100A"), and photosensitive drums 1 (1*y*, 1*m*, 1*c* and 1*k*) as image bearing members installed in the apparatus main body 100A. The photosensitive drums 1 are rotatably supported by a driving unit (not illustrated). Charging devices 2 (2*y*, 2*m*, 2*c* and 2*k*), exposing devices 3 (3*y*, 3*m*, 3*c* and 3*k*), developing devices 4 (4*y*, 4*m*, 4*c* and 4*k*) and cleaning devices 5 (5*y*, 5*m*, 5*c* and 5*k*) are arranged in this order around the respective photosensitive drums 1. Primary transfer rollers 7 are arranged at the downstream side of the respective developing devices 4 in the recording material conveying direction Y across an intermediate transfer belt 6. The primary transfer rollers 7 constitute a primary transfer portion.

The surface of each photosensitive drum 1 is charged by the charging device 2, and an electrostatic image is formed on the photosensitive drum 1 by the exposing device 3. The developing device 4 transfers toner to the electrostatic image to form a toner image. Toner images of yellow, magenta, cyan and black are respectively developed on the four photosensitive drums 1. The toner images are transferred to the intermediate transfer belt 6 via the primary transfer portion. The cleaning device 5 on the photosensitive drum 1 removes transfer residual toner remaining on the photosensitive drum 1 without being transferred to the intermediate transfer belt 6 at the primary transfer portion.

The intermediate transfer belt 6 is stretched over and looped around a driving roller 8, a tension roller 9 and a secondary transfer inner roller 10 in a substantially triangular shape. The intermediate transfer belt 6 is rotatably supported by a driving unit (not illustrated) via the driving roller 8. The tension roller 9 is slidable, and a spring member 20 applies a force to the intermediate transfer belt 6. Each of the stretching rollers is supported by front and rear side plates (not illustrated) via bearings. In addition, the primary transfer rollers 7 and a plurality of idler rollers are arranged at the inner side of the intermediate transfer belt 6. Furthermore, a belt position changing device 21 is arranged between the tension roller 9 and the secondary transfer inner roller 10. A secondary transfer outer roller 12 and a transfer cleaning device 13 are arranged around the intermediate transfer belt 6.

A secondary transfer portion 11 is constituted by the secondary transfer inner roller 10 and the secondary transfer outer roller 12 nipping the intermediate transfer belt 6. The toner image on the intermediate transfer belt 6 is transferred to a recording material P at the secondary transfer portion 11. The recording material P includes paper and a plastic sheet.

The transfer cleaning device 13 removes residual toner remaining on the intermediate transfer belt 6 without being transferred to the recording material P at the secondary transfer portion 11. A fixing device 14 includes a fixing roller 14*a* and a pressure roller 14*b*, and is configured to fix the toner image transferred to the recording material P by applying heat and pressure to the recording material P. The recording material P is fed by a storage unit 15, and the posture of the recording material P is corrected by a pair of registration rollers 16. Then, the recording material P passes through the secondary transfer portion 11 and the fixing device 14, and is discharged onto a discharge tray 17.

A lower secondary transfer entrance guide 18 and an upper secondary transfer entrance guide 19 which guide conveyance of the recording material P are arranged between the pair of registration rollers 16 and the secondary transfer portion 11. An extended line of the lower secondary transfer entrance guide 18 is directed toward the secondary transfer portion 11, thereby the leading end of the recording material P which has passed through the pair of registration rollers 16 is guided to the secondary transfer portion 11. The upper secondary transfer entrance guide 19 is arranged at a position close to, but not in contact with, the intermediate transfer belt 6.

An environmental sensor 29, which is an environment detection unit, is installed in the storage unit 15 where recording materials P are stored. The environmental sensor 29 detects the temperature and the humidity inside the storage unit 15. The environmental sensor 29 functions as a temperature and humidity sensor, which may be called a temperature and humidity detection unit. A recording material thickness sensor 28, which is a recording material thickness detection unit, is provided at the upstream side of the secondary transfer portion 11 in the recording material conveying direction Y. The recording material thickness sensor 28 detects the thickness of a recording material P when the recording material P passes. Furthermore, a recording material size sensor 30, which is a recording material size detection unit, is installed in the storage unit 15 where recording materials P are stored. The recording material size sensor 30 detects the size of the stored recording material P in cooperation with a side regulating plate and a rear end regulating plate.

Since the structure and the operation of the image forming unit of the image forming apparatus 100 other than the belt position changing device 21 in the embodiment are similar to those of a typical electrophotographic image forming apparatus of the intermediate transfer system, further details are not provided. The image forming unit includes at least a photosensitive drum 1, a charging device 2, an exposing device 3 and a developing device 4.

Figure 1B:
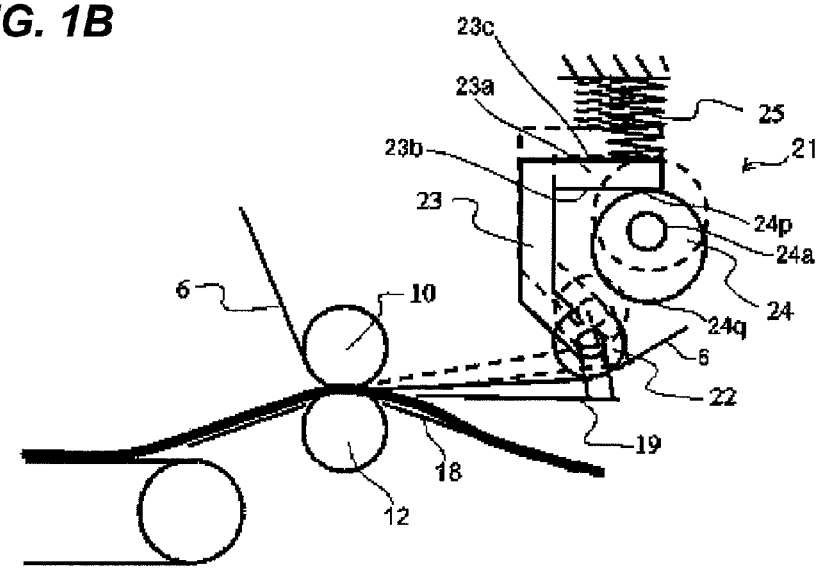
FIG. 1B is a sectional view illustrating a structure of a belt position changing device.

FIG. 1B is a sectional view illustrating a structure of the belt position changing device 21, which is a changing unit. As illustrated in FIG. 1B, the belt position changing device 21 includes an adjustment idler roller 22 over which the intermediate transfer belt 6 is stretched, and a bearing portion (not illustrated) which rotatably supports the adjustment idler roller 22. The belt position changing device 21 also includes a supporting member 23, which is formed into a U-shape in cross section and supports the bearing portion (not illustrated), and an eccentric cam 24, which is coupled to a drive motor (not illustrated) to rotate. The belt position changing device 21 further includes a spring member 25 having an end fixed to the supporting member 23. The spring member 25 is a force applying unit which applies a force to the adjustment idler roller 22 toward the intermediate transfer belt 6 via the supporting member 23.

The intermediate transfer belt 6, which is a belt member, is a rotatable belt stretched over the driving roller 8, the tension roller 9 and the secondary transfer inner roller 10, which are a plurality of rollers. The intermediate transfer belt 6 is rotatable in the belt moving direction X. The supporting member 23 is slidably supported by the front and rear side plates of the apparatus main body 100A which support the driving roller 8, the secondary transfer inner roller 10 and the tension roller 9 over which the intermediate transfer belt 6 is stretched.

An abutment portion 23*a* of the supporting member 23 includes a first face 23*b* and a second face 23*c*. The abutment portion 23*a* abuts a cam face of the eccentric cam 24 at the first face 23*b* and is in contact with the spring member 25 at the second face 23*c*. The eccentric cam 24 has a rotational shaft 24*a*, which is the center of rotation. The eccentric cam 24 also has a minimum distance pressed point 24*p*, at which the distance between the rotational shaft 24*a* and the circumference of the eccentric cam 24 is shortest, and a maximum distance pressed point 24*q*, at which the distance between the rotational shaft 24*a* and the circumference is longest. The cam face having the minimum distance pressed point 24*p* and the maximum distance pressed point 24*q* is adapted to be pressed by the supporting member 23, to which a force is applied downward by the spring member 25.

When the minimum distance pressed point 24*p* is in contact with the supporting member 23 after rotation of the eccentric cam 24, the supporting member 23 is at the lowermost position. Thus, a force is applied to the adjustment idler roller 22, which is supported by the supporting member 23, downward at the lowermost position. Then, a force is applied to the portion of the intermediate transfer belt 6, which is pressed by the adjustment idler roller 22, downward at the lowermost position. In this state, the distance between the portion of the intermediate transfer belt 6 in contact with the adjustment idler roller 22 and the lower secondary transfer entrance guide 18 is set to be the minimum distance. Further, the intersection angle θ (see FIGS. 2A and 2B), which will be described below, reaches the maximum value in this state.

When the maximum distance pressed point 24*q* is in contact with the supporting member 23 after rotation of the eccentric cam 24, the supporting member 23 is at the uppermost position. Thus, a force is applied to the adjustment idler roller 22, which is supported by the supporting member 23, downward at the uppermost position. Then, a force is applied to the portion of the intermediate transfer belt 6, which is pressed by the adjustment idler roller 22, downward at the uppermost position. In this state, the distance between the portion of the intermediate transfer belt 6 in contact with the adjustment idler roller 22 and the lower secondary transfer entrance guide 18 is set to be the maximum distance. Further, the intersection angle θ (see FIGS. 2A and 2B), which will be described below, reaches the minimum value in this state.

Therefore, the belt position changing device 21, which is the changing unit, is a device which changes the advancing angle α (see FIGS. 2A and 2B) of the intermediate transfer belt 6 advancing into the secondary transfer portion 11 between the secondary transfer inner roller 10 and the secondary transfer outer roller 12, which are the pair of secondary transfer rollers. As described above, the advancing angle α of the intermediate transfer belt 6 to the secondary transfer portion 11 changes as the position of the adjustment idler roller 22 moves. The advancing angle α will be described below. The advancing angle α is an angle between a line perpendicular to a line connecting the respective centers of the pair of rollers and the belt face. Alternatively, the advancing angle α can be equally expressed as $\alpha=90-\beta$ where β represents the angle between the line connecting the centers and the belt face.

The upper secondary transfer entrance guide 19, which is a regulating member, is arranged between the lower secondary transfer entrance guide 18 and the intermediate transfer belt 6. The upper secondary transfer entrance guide 19 prevents a recording material P, which is curved at the leading end thereof, from being in contact with the intermediate transfer belt 6 at the upstream side of the secondary transfer portion 11 in the recording material conveying direction Y and causing an image defect. On the other hand, the lower secondary transfer entrance guide 18, which is a guide member, is arranged at the upstream side of the secondary transfer portion 11 in the recording material conveying direction Y to guide the recording material P to the secondary transfer portion 11.

A controller 50 (see FIG. 1A) controls the drive of the belt position changing device 21 so that the advancing angle α of the intermediate transfer belt 6 advancing into the secondary transfer portion 11 is larger as the rigidity of the recording material P is higher. The regulated position of the upper secondary transfer entrance guide 19 moves in the direction away from the intermediate transfer belt 6 along with the movement of the intermediate transfer belt 6 increasing the advancing angle α.

On the contrary, the controller 50 (see FIG. 1A) controls the drive of the belt position changing device 21 so that the advancing angle α of the intermediate transfer belt 6 advancing into the secondary transfer portion 11 is smaller as the rigidity of the recording material P is lower. The regulated position of the upper secondary transfer entrance guide 19 moves in the direction approaching the intermediate transfer belt 6 along with the movement of the intermediate transfer belt 6 decreasing the advancing angle α.

Figure 2A:
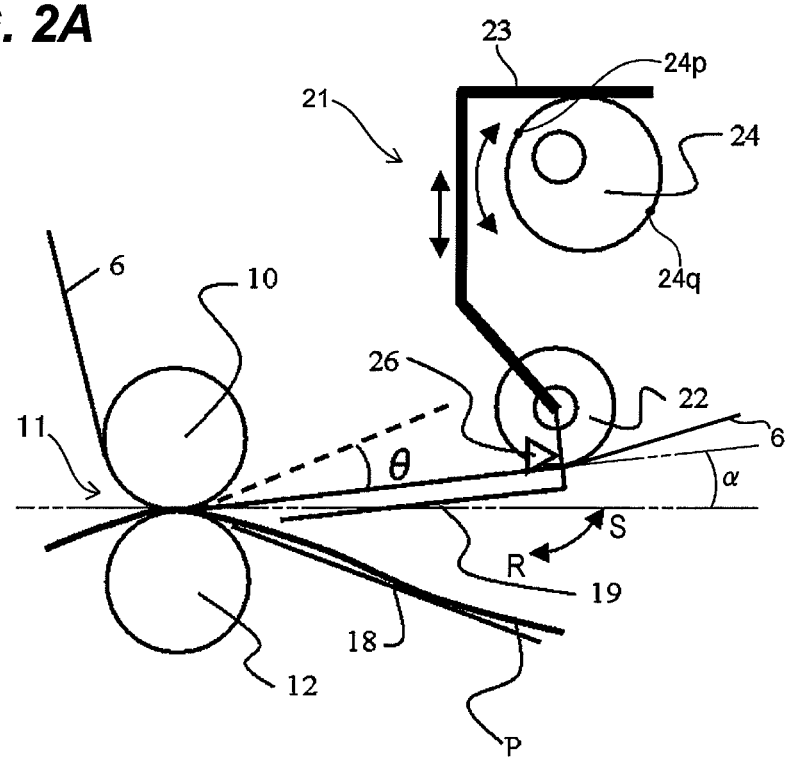
FIG. 2A is a process diagram illustrating an operation of an adjustment idler roller operated by the belt position changing device.

FIG. 2A is a process diagram illustrating an operation of the adjustment idler roller 22 operated by the belt position changing device 21. As illustrated in FIG. 2A, the upper secondary transfer entrance guide 19 is arranged beneath the supporting member 23. The upper secondary transfer entrance guide 19 is attached to the supporting member 23 with a pin (not illustrated). Accordingly, as the supporting member 23 moves, the pin (not illustrated) and the upper secondary transfer entrance guide 19 as well as the adjustment idler roller 22 moves.

In addition, a force is applied to the upper secondary transfer entrance guide 19 along with the supporting member 23 downward by the spring member 25. On the other hand, an abutment portion 26 which the upper secondary transfer entrance guide 19 can abut is formed on the front side plate and the rear side plate (not illustrated) of the apparatus main body 100A. As illustrated in FIG. 2A, when the adjustment idler roller 22 is at a lower position, the upper secondary transfer entrance guide 19 is not in contact with the abutment portion 26. FIG. 2A illustrates the positional relation between the intermediate transfer belt 6 and the upper secondary transfer entrance guide 19 in a state where the adjustment idler roller 22 is close to the lowermost position and when an image is transferred to coated paper having a relatively low rigidity of 81.4 g/m2.

Figure 2B:
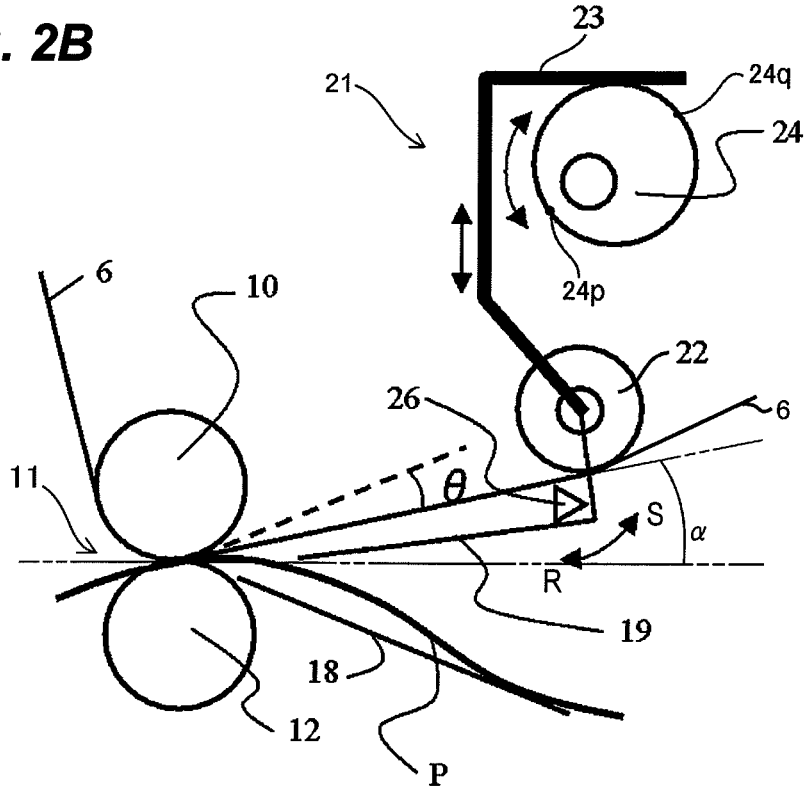
FIG. 2B is a process diagram illustrating an operation of an adjustment idler roller operated by the belt position changing device.

FIG. 2B is a process diagram illustrating an operation of the adjustment idler roller 22 operated by the belt position changing device 21. As illustrated in FIG. 2B, as the point at which the eccentric cam 24 is in contact with the supporting member 23 moves from the minimum distance pressed point 24*p* to the maximum distance pressed point 24*q*, the supporting member 23 and the adjustment idler roller 22 are lifted and the upper secondary transfer entrance guide 19 is also lifted. At this time, the upper secondary transfer entrance guide 19 abuts the abutment portion 26 and swings in the direction indicated by an arrow S while being lifted upward by the supporting member 23. Accordingly, as illustrated in FIG. 2B, the upper secondary transfer entrance guide 19 can move in the direction away from the secondary transfer portion 11. Such vertically-upward and rightward movement of the coordinate of the upper secondary transfer entrance guide 19 allows the recording material P to move forward without being hindered by the upper secondary transfer entrance guide 19 even when the recording material P has high rigidity and is curved. FIG. 2B illustrates the positional relation between the intermediate transfer belt 6 and the upper secondary transfer entrance guide 19 in a state where the adjustment idler roller 22 is close to the uppermost position and when an image is transferred to plain paper having a relatively high rigidity of 300 g/m2.

Figure 3A:
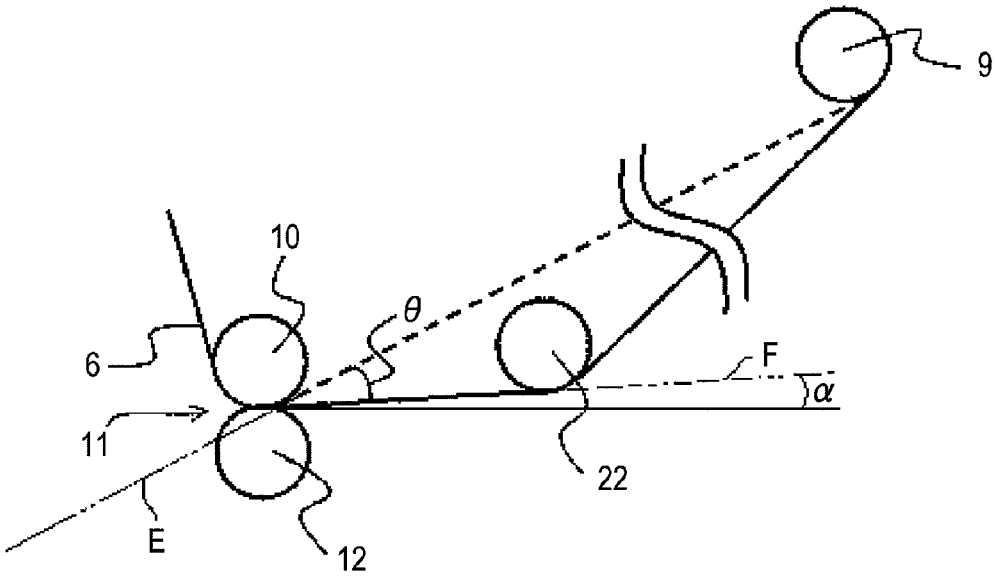
FIG. 3A is a sectional view illustrating the advancing angle of an intermediate transfer belt to a secondary transfer portion.

FIG. 3A is a sectional view illustrating the advancing angle α of the intermediate transfer belt 6 to the secondary transfer portion 11. As illustrated in FIG. 3A, the most upstream stretching roller in the rotational direction of the adjustment idler roller 22 is the tension roller 9. Thus, a line tangent to both the tension roller 9 and the secondary transfer inner roller 10 is defined as a tangent line E, and a line tangent to both the adjustment idler roller 22 and the secondary transfer inner roller 10 is defined as a tangent line F. In this case, the intersection angle θ between the tangent line E and the tangent line F is smaller for plain paper having a relatively high rigidity of 300 g/m2 than for coated paper having a relatively low rigidity of 81.4 g/m2.

FIG. 3B is a table illustrating a relation between the type of the recording materials P and the intersection angle θ. Two types of the recording materials P, which are plain paper and coated paper, are described in the table. As illustrated in FIG. 3B, as the basis weight of the recording material P is larger, the thickness of the recording material P is larger and the rigidity of the recording material P is larger. Therefore, the intersection angle θ is set to a smaller value as the basis weight is larger. Further, as the humidity of the environment is lower, the absorbed moisture amount is lower and thus the rigidity of the recording material P is higher. Therefore, the intersection angle θ is set to a smaller value as the humidity is lower. Further, when the paper grain extending in the recording material conveying direction Y is defined as long grain and the paper grain extending perpendicular to the recording material conveying direction Y is defined as short grain, the long grain has higher rigidity. Therefore, the intersection angle θ is set to a smaller value for the long grain. The value of the intersection angle θ varies according to the shapes and other configurations of a steering roller and an idler roller (not illustrated) constituting an intermediate transfer unit, or those of the conveyance path of the recording material P. The numerical values in FIG. 3B are presented by way of example only.

It can be seen by comparing FIGS. 2A and 2B that the position of the upper secondary transfer entrance guide 19 is farther from the secondary transfer portion 11 for the plain paper having the relatively high rigidity of 300 g/m2, so that the recording medium P is conveyed in a posture more suitable to the rigidity of the recording material P. Therefore, the image can be transferred at the secondary transfer portion 11 without increasing the conveying resistance to the recording material P.

The advancing angle α of the intermediate transfer belt 6 advancing into the secondary transfer portion 11 and the position of the upper secondary transfer entrance guide 19 are changed depending on the use environment of the image forming apparatus 100 and the thickness, size, type and paper grain of the recording material P. Further, the tension of the intermediate transfer belt 6 is lowered as the rigidity of the recording material P in the recording material conveying direction Y is higher. Accordingly, the impact acting on the intermediate transfer belt 6 when the rear end of the recording material P comes in contact with the intermediate transfer belt 6 becomes less likely to be transmitted to the image forming portion. As a result, there is also an effect that an unintended line in an image caused by the impact becomes less likely to be generated.

Figure 3C:
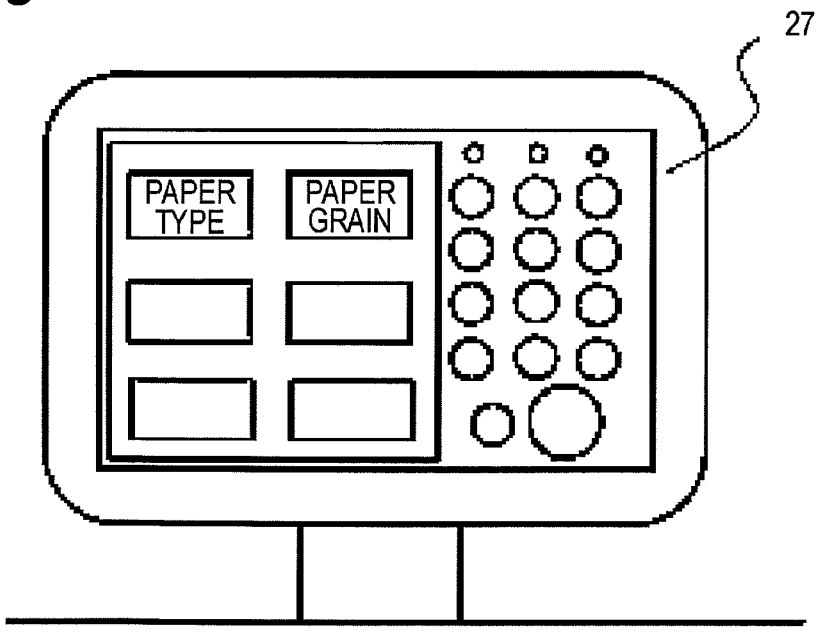
FIG. 3C is a front view illustrating a configuration of a recording material information inputting device.

FIG. 3C is a front view illustrating a configuration of a recording material information inputting device 27. As illustrated in FIG. 3C, entries input on a setting screen of the recording material information inputting device 27, which is a recording material information inputting unit, include information of the recording material such as the type and the paper grain of the recording material P. These entries can be changed as necessary. The user sets the paper type and the paper grain for the image forming apparatus 100 to recognize the set data before using the image forming apparatus 100. Although the items of paper type and paper grain of the recording material P are listed, the items of entries are not limited thereto. The information is input in the controller 50, which controls the rotation of the drive motor and determines the rotational angle of the eccentric cam 24 based on the input information. The phase of the eccentric cam 24 is controlled based on a standby position, which is detected by a standby position sensor before the eccentric cam 24 moves to the determined position. If disturbance is applied to the intermediate transfer belt 6 during image formation and causes a change in the speed of the photosensitive drum 1 or the intermediate transfer belt 6, an image defect such as color shift occurs. Therefore, the positional control of the eccentric cam 24 is preferably completed before starting image formation.

The controller 50 determines the rigidity of the recording material P based on the detection result of the environmental sensor 29, the detection result of the recording material thickness sensor 28 and the input result of the recording material information inputting device 27 to control driving of the belt position changing device 21. In addition, the image forming apparatus 100 may also include a recording material size sensor which is a recording material size detection unit that detects the size of the recording material P as the "information of the recording material". In this case, the controller 50 determines the rigidity of the recording material P based on the results including the detection result of the recording material size sensor to control driving of the belt position changing device 21.

According to the configuration of the embodiment, the load applied to the recording material P during secondary transfer is reduced by changing the advancing angle α of the intermediate transfer belt 6. In addition, since the posture of the recording material P becomes stable in and out of the transfer electric field, image defects caused by scattering of toner occurring at the secondary transfer portion 11 are reduced.

The effects of the embodiment will be supplementarily described below. A system employing an intermediate transfer member in an image forming apparatus is becoming a predominant system in color image forming apparatuses to meet a recent demand for improving the output productivity. In particular, the intermediate transfer belt system which uses a belt as the intermediate transfer member is employed more often than the system which uses a drum as the intermediate transfer member because the cross sectional arrangement of the image forming apparatus can be more flexibly designed. However, the intermediate transfer belt system is disadvantageous in that image defects occur when a toner image is transferred to a recording material. In particular, an image defect of scattering due to scattering of toner resulting in that a toner image on an intermediate transfer belt cannot be accurately transferred is noted.

Here, the mechanism of generating a defective image due to scattering is described. For example, a case where the image forming apparatus 100 does not include the belt position changing device 21 in FIG. 1A is assumed. In this case, if transfer bias is applied to the secondary transfer portion 11, an electric field is generated in and around the nip formed by the secondary transfer inner roller 10 and the secondary transfer outer roller 12 of the secondary transfer portion 11.

If a gap is generated between the intermediate transfer belt 6 and the recording material P in the electric field, abnormal electrical discharge is generated in the gap, which cancels the electric charge of the toner layer electrostatically adhered to the intermediate transfer belt 6. Consequently, the toner scatters to unintended positions and is not transferred on the recording material P when the transfer bias is applied, causing an image defect. Moreover, the toner also scatters outside the electric field when the toner image on the intermediate transfer belt 6 and the recording material are in friction with each other, and the recording material is conveyed into the transfer electric field with the scattering toner. As a result, an image defect is generated.

Japanese Patent Application Laid-Open No. 2003-167444 mentioned above discusses a system which controls the speed of a pair of registration rollers to prevent generation of image defects in the electric field. However, it is difficult to support a wide variety of recording materials by the system, and image defects are caused by frictional action between the intermediate transfer belt and the recording material P outside the electric field.

The generation of image defects outside the electric field can also be prevented by optimizing the position of the upper secondary transfer entrance guide 19 and forcibly changing the posture of the recording material P so that the intermediate transfer belt 6 and the recording material P do not come into friction with each other. However, if the rigidity of the recording material P becomes higher, the conveying resistance of the upper secondary transfer entrance guide 19 increases and a slippage occurs at the secondary transfer portion 11. As a result, a problem that the image magnification becomes unstable occurs.

Figure 4A:
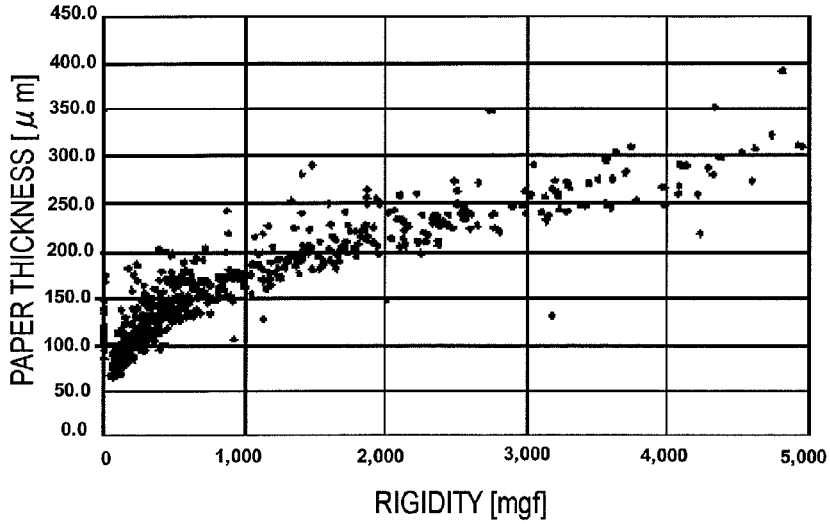
FIG. 4A is a graph which plots the thickness and the rigidity of various recording materials.

FIG. 4A is a graph which plots the thickness and the rigidity of various recording materials P. As illustrated in FIG. 4A, the graph illustrates that the rigidity significantly varies even at the same thickness of the recording materials P. It is also known that the rigidity of the recording material P is influenced by the moisture amount absorbed by the recording material P, the difference in the paper grain and the type of paper (such as plain paper, coated paper and film paper) in addition to the thickness of the recording material P. When the moisture amount increases, the rigidity of the recording material P becomes lower. When the paper grain is in the direction perpendicular to the conveying direction, the rigidity becomes lower. In addition, it is also observed that the posture of the recording material P changes depending on the change in the recording material size in the direction perpendicular to the recording material conveying direction Y.

As described above, it has been increasingly difficult for the conventional system to support a wide variety of recording materials to prevent image defects generated at the secondary transfer portion 11 when more and more types of recording materials should be supported. The types of recording materials P to be supported have increased. For example, the basis weight of the recording materials may vary from 36 g/m2 to 350 g/m2, which illustrates that the thickness (paper thickness) varies by more than twice with the same type (paper type) of material. The size may also vary by more than twice from A5 size to 13 inch×19 inch size in the main scanning direction. In addition, a wide variety of recording materials P having different rigidity, such as plain paper, gloss paper, mat paper and overhead transparency paper, should be supported.

Each of these varieties of recording material P is immediately curved when the leading end thereof is held by the nip portion of the secondary transfer portion 11 and conveyed in the state curved like an arch downward in the direction of gravitational force. The curved posture is different for each recording material P in a manner that the recording material P comes closer to the intermediate transfer belt 6 as the rigidity thereof is higher.

Figure 4B:
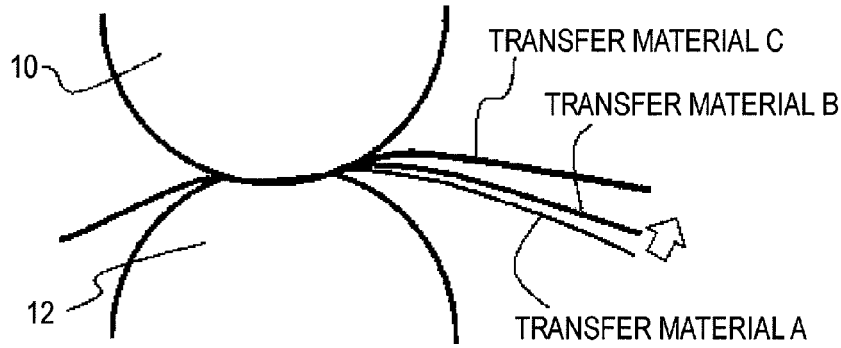
FIG. 4B is a schematic view illustrating postures of recording materials A, B and C having different rigidity when the recording materials A to C pass through a secondary transfer portion 11, assuming that an intermediate transfer belt 6 is not present.

FIG. 4B is a schematic view illustrating postures of recording materials A, B and C having different rigidity when the recording materials A to C pass through the secondary transfer portion 11, assuming that the intermediate transfer belt 6 is not present. The secondary transfer outer roller 12 is a sponge roller having low rubber hardness, and thus deforms to form a wider nip region. Since the recording material P is forcibly deformed in the nip, the curved posture of the recording material C having high rigidity is shifted toward the direction opposite to the direction of gravitational force as compared to the recording material A having low rigidity when the recording material P is held in a state where the intermediate transfer belt 6 is not present, as illustrated in FIG. 4B.

Figure 4C:
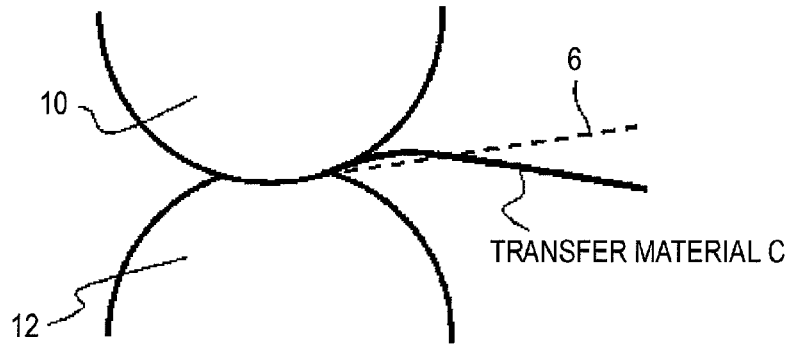
FIG. 4C is a schematic view illustrating a relation between an actual position of the intermediate transfer belt 6 and the position of the recording material C, assuming that the intermediate transfer belt 6 is not present.

FIG. 4C is a schematic view illustrating a relation between an actual position of the intermediate transfer belt 6 and the position of the recording material C, assuming that the intermediate transfer belt 6 is not present. The position of the intermediate transfer belt 6 in relation to the recording material C having high rigidity is as illustrated by a broken line in FIG. 4C. As illustrated in FIG. 4C, it can be seen that the posture of the recording material C extends across the intermediate transfer belt 6. If the recording material C is conveyed in such a state, the recording material C gets curved while being conveyed. Then, the conveying resistance at the upper secondary transfer entrance guide 19 becomes large, resulting in unstable conveyance of the recording material C. If the recording material gets curved, a gap between the recording material and the intermediate transfer belt 6 is generated in the transfer electric field, causing a scattering image defect. If the conveyance becomes unstable, the recording material C comes in friction with the image on the intermediate transfer belt 6, causing an image defect due to scattering of the toner image.

The intermediate transfer belt 6 may be arranged at an upper position to avoid the image defect. In such case, however, when the recording material A having low rigidity is conveyed, the recording material gets away from the intermediate transfer belt 6 at the transfer region formed in the vicinity of the nip, causing a scattering image defect in the transfer electric field.

Therefore, the position of the intermediate transfer belt 6 and the posture of the recording material P need to be controlled for each recording material P as in the above-described embodiment of the present application to prevent the image defects in various recording materials P.

As described above, according to the present invention, the load applied to the recording material during secondary transfer is reduced and the posture of the recording material P becomes stable in and out of the transfer electric field by changing the advancing angle of the belt member, thereby image defects caused by scattering of toner occurring at the secondary transfer portion are reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-179900, filed Jul. 31, 2009, which is hereby incorporated by reference herein in its entirety.

What is claimed is:

1. An image forming apparatus comprising:

a toner image forming portion for forming a toner image;

a rotatable belt member which bears a toner image formed by the toner image forming portion;

a transfer portion for forming a transfer nip portion which transfers the toner image on the belt member on to a recording material;

an adjustment roller that is located next to the transfer portion at an upstream side of the transfer portion and at a downstream side of the toner image forming portion, in a belt moving direction of the belt member, and sets up the belt member by coming into contact with an inside surface of the belt member;

a moving unit for moving the adjustment roller so that an advancing angle of the belt member advancing into the transfer nip portion changes;

a guide member, which is arranged at an upstream side of the transfer nip portion in a recording material conveying direction and adapted to come in contact with a face of a recording material opposite to a face to which the toner image is transferred from the belt member, to guide the recording material to the transfer nip portion; and a controller for controlling the moving unit so that a belt face advancing into the transfer nip portion when a recording material having a first thickness is conveyed to the transfer nip portion is at a position farther from the guide member than the belt face advancing into the transfer nip portion when a recording material having a second thickness, smaller than the first thickness, is conveyed to the transfer nip portion.

2. The image forming apparatus according to claim 1, further comprising a regulating member which is arranged at an upstream side of the transfer nip portion in the recording material conveying direction to face the face of the recording material to which the toner image is transferred from the belt member and adapted to regulate the recording material, wherein the regulating member is at a position farther from the guide member when the recording material having the first thickness is conveyed to the transfer nip portion than a position of the regulating member when the recording material having the second thickness is conveyed to the transfer nip portion.

3. The image forming apparatus according to claim 2, wherein the regulating member moves in conjunction with movement of the adjustment roller moved by the moving unit.

4. An image forming apparatus comprising:

a toner image forming portion for forming a toner image;

a rotatable belt member which bears a toner image formed by the toner image forming portion;

a transfer portion forming a transfer nip portion which transfers the toner image on the belt member on to a recording material;

an adjustment roller that is located next to the transfer portion at an upstream side of the transfer portion and at a downstream side of the toner image forming portion, in a belt moving direction of the belt member, and sets up the belt member by coming into contact with an inside surface of the belt member;

a moving unit for moving the adjustment roller so that an advancing angle of the belt member advancing into the transfer nip portion changes;

a guide member, which is arranged at an upstream side of the transfer nip portion in a recording material conveying direction and adapted to come in contact with a face of a recording material opposite to a face to which the toner image is transferred from the belt member, to guide the recording material to the transfer nip portion; and a controller for controlling the moving unit so that a belt face advancing into the transfer nip portion when a recording material having a first rigidity is conveyed to the transfer nip portion is at a position farther from the guide member than the belt face advancing into the transfer nip portion when a recording material having a second rigidity, lower than the first rigidity, is conveyed to the transfer nip portion.

5. The image forming apparatus according to claim 4, further comprising a regulating member which is arranged at an upstream side of the transfer nip portion in the recording material conveying direction to face the face of the recording material to which the toner image is transferred from the belt member and adapted to regulate the recording material, wherein the regulating member is at a position farther from the guide member when the recording material having the first rigidity is conveyed to the transfer nip portion than a position of the regulating member when the recording material having the second rigidity is conveyed to the transfer nip portion.

6. The image forming apparatus according to claim 5, wherein the regulating member moves in conjunction with movement of the adjustment roller moved by the moving unit.

7. The image forming apparatus according to claim 4, further comprising an environmental detection unit which detects a temperature and a humidity;

a recording material thickness detection unit which detects a thickness of a recording material;

a recording material size detection unit which detects a size of a recording material; and a recording material information inputting unit which inputs information of a recording material, wherein the controller determines a rigidity of a recording material and controls the drive of the moving unit based on:

a detection result of the environmental detection unit;

a detection result of the recording material thickness detection unit;

a detection result of the recording material size detection unit; and an input result of the recording material information inputting unit.

* * * * *